US009477204B2

(12) United States Patent
Goeller

(10) Patent No.: US 9,477,204 B2
(45) Date of Patent: Oct. 25, 2016

(54) TRUE PERPETUAL CALENDAR DEVICE

(71) Applicant: Montres Breguet S.A., L'Abbaye (CH)

(72) Inventor: Eric Goeller, Colombier (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 14/976,577

(22) Filed: Dec. 21, 2015

(65) Prior Publication Data

US 2016/0187852 A1 Jun. 30, 2016

(30) Foreign Application Priority Data

Dec. 29, 2014 (EP) ..... 14200380

(51) Int. Cl.
*G04B 19/253* (2006.01)
*G04B 19/24* (2006.01)
*G04B 19/25* (2006.01)

(52) U.S. Cl.
CPC ..... *G04B 19/24* (2013.01); *G04B 19/25* (2013.01); *G04B 19/2536* (2013.01)

(58) Field of Classification Search
CPC .. G04B 19/2536; G04B 19/26; G04B 19/08; G04B 19/2571; G04B 19/247; G04B 19/24313; G04B 19/23
See application file for complete search history.

(56) References Cited

U.S. PATENT DOCUMENTS 2,147,280 A 2/1939 Basler
2,170,408 A 8/1939 Hillcourt
3,716,983 A * 2/1973 Tanaka ..... G04B 19/2536 368/28
5,184,333 A * 2/1993 Caspar ..... G04B 19/24 368/28
5,473,580 A * 12/1995 Gilomen ..... G04C 3/146 368/110
7,027,360 B2 * 4/2006 Kitahara ..... G04C 17/0066 368/28
7,782,715 B2 * 8/2010 Crettex ..... G04B 19/2536 368/28
8,711,658 B2 * 4/2014 Goeller ..... G04B 19/2536 368/28
9,285,774 B2 * 3/2016 Rochat ..... G04B 19/262
2009/0274010 A1 * 11/2009 Vuilleumier ..... G04B 19/268 368/18

FOREIGN PATENT DOCUMENTS

CH 498 442 A 3/1970

OTHER PUBLICATIONS

European Search Report issued Oct. 19, 2015 in European Application 14200380, filed on Dec. 29, 2014 (with English Translation).

* cited by examiner

*Primary Examiner* — Sean Kayes
(74) *Attorney, Agent, or Firm* — Oblon, McClelland, Maier & Neustadt, L.L.P.

(57) ABSTRACT

Calendar mechanism for timepieces, displaying the duration of the current month and comprising a month cam whose periphery is accessible to a feeler-spindle of a perpetual calendar device to obtain the duration of the current month, this calendar mechanism and the month cam being updated monthly on each current month change by the perpetual calendar device, the month cam is generalised to an integer number of years each including a virtual 28-day month of February, the calendar mechanism includes a leap year mechanism, external to the month cam, and which is arranged to insert radially, every four years in February, a first corrector finger between the periphery and the feeler-spindle to inform the latter that the current month of February has 29 days instead of 28.

19 Claims, 3 Drawing Sheets

TRUE PERPETUAL CALENDAR DEVICE

This application claims priority from European patent application No. 14200380.5 filed Dec. 29, 2014, the entire disclosure of which is hereby incorporated herein by reference.

FIELD OF THE INVENTION

The invention concerns a calendar mechanism for a perpetual calendar device for timepieces, said calendar mechanism being arranged to display the duration of the current month and including a month cam whose periphery is accessible to a feeler-spindle of a perpetual calendar device for obtaining information on the duration of the current month, wherein said calendar mechanism and said month cam are arranged to be updated monthly on each current month change by a said perpetual calendar device.

The invention also concerns a perpetual calendar device for timepieces comprising one such calendar mechanism and a day counter mechanism which includes a feeler-spindle for measuring the duration of the current month and an end-of-month correction mechanism, said feeler-spindle obtaining information on the current month duration from said periphery of said month cam.

The invention also concerns a timepiece mechanism including a timepiece movement arranged to control the daily release, at the moment that the date changes, of a mechanism actuating such a perpetual calendar device, and comprising a display mechanism including at least date display means controlled by said calendar mechanism.

The invention also concerns a timepiece including such a timepiece mechanism.

The invention concerns the field of calendar display mechanisms in mechanical watches, and more particularly perpetual calendar displays.

BACKGROUND OF THE INVENTION

The most conventional calendar timepieces are described in the technical literature of horology.

The function of a so-called perpetual calendar device is to determine the number of days in the current month, and, more specifically, in the month of February. The perpetual mechanism is an approximate notion: most commercially available mechanisms are simple leap year mechanisms, either using a 48-notch month cam, or a month cam with 12 positions, wherein the position of the month of February comprises a leap year mechanism comprising a Maltese Cross or similar element, to name the most common devices.

The very specific management of end-of-century years, and quadricentennial years, imposed by the Gregorian calendar, makes these applications very rare, only end-of-century years are actually found in a few watches considered to be very highly complicated watches. Quadricentennial years and quadrimillennial years are only encountered in astronomical clocks, including the Strasbourg Cathedral clock perfected by Schwilgué in the XIXth century.

The design of a perpetual calendar device meets with two difficulties:

- how to take account of the specificities of the type of calendar concerned and translate this into the form of a timepiece mechanism, and
- how to update such a mechanism in case of stoppage. Updating is often so complex that the timepiece must never be stopped, as is the case of astronomical clocks for buildings. Even in the case of the most basic version of a perpetual Gregorian calendar that simply manages leap years in four-year cycles, any updating is accomplished by a large number of operations, up to 47 manoeuvres to arrive at the right year and the right month, which results in wear of the mechanisms.

SUMMARY OF THE INVENTION

The invention proposes to facilitate the correction of a perpetual calendar device, regardless of its level of complexity.

The simple solution, with a reduced number of components, also allows for easier creation of a true perpetual calendar, which actually incorporates end-of-century years, quadricentennial years, or even quadrimillennial years.

To this end, the invention concerns a calendar mechanism for a perpetual calendar device for timepieces, said calendar mechanism being arranged to display the duration of the current month and including a month cam whose periphery is accessible to a feeler-spindle of a perpetual calendar device for obtaining information on the duration of the current month, wherein said calendar mechanism and said month cam are arranged to be updated monthly on each current month change by a said perpetual calendar device, characterized in that said month cam is generalised to an integer number of years each including a virtual 28-day month of February, and in that said calendar mechanism includes a leap year mechanism external to said month cam and arranged to insert radially, every four years in February, a first corrector finger between the periphery of said month cam and a said feeler-spindle to inform the latter that the current month of February has 29 days instead of 28.

The invention also concerns a perpetual calendar device for timepieces including such a calendar mechanism and a day counter mechanism which includes a feeler-spindle for measuring the duration of the current month and an-end-of month correction mechanism, said feeler-spindle obtaining information on the duration of the month from said periphery of said month cam, characterized in that said day counter mechanism determines the current day of the month, controls the date display, and, on each change of current month, controls a motion of said month cam to update said calendar mechanism, and said leap year mechanism which it drives.

The invention also concerns a timepiece mechanism including a timepiece movement arranged to control the daily release, at the moment that the date changes, of a mechanism actuating such a perpetual calendar device, and comprising a display mechanism including at least date display means controlled by said calendar mechanism.

The invention also concerns a timepiece including such a timepiece mechanism.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
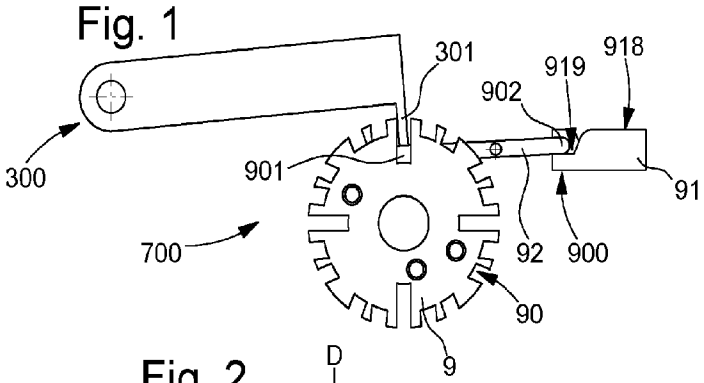
FIG. 1 shows a schematic, partial top view of perpetual calendar device according to the invention, in a simplified embodiment for managing the leap years, in a position where the mechanism makes a correction which corresponds to a 29-day February.

The invention presents a correction mechanism for a calendar mechanism of a perpetual calendar device.

The invention also presents a true perpetual calendar device, which actually incorporates the end-of-century year, quadricentennial year, and quadrimillennial year complications in the Gregorian calendar.

The invention is described in the preferred application in Europe to the Gregorian calendar. It is, however, applicable to any type of calendar that includes months of different length from one year to another.

The present description does not illustrate the entire display mechanism, and is limited to illustrating how to enable a feeler-spindle to read, on a mobile element, a precise piece of information regarding the duration of the current period. The mobile element is a month cam here, and the current period is a current month. This particular application is non-limiting, and those skilled in the art will know how to transpose it to other of calendar types, such as lunar calendars, calendars with correction periods, or others. The feeler-spindle is also a particular application, which may be replaced by any other display control mechanism. The invention is applicable to any calendar display that may or may not be retrograde or instantaneous.

As illustrated, the perpetual calendar device includes components that are essentially cams and levers, the form of which is shown merely by way of illustration here, and which is essentially dictated by the other complications comprised in the timepiece, and by the requirement to prevent any interference, which may result in more complex forms than required for the actual functions. Naturally, these components may be replaced or supplemented by other components fulfilling similar functions, notably wheels, stars, or other elements.

Some mobile elements illustrated here have a very long periodicity, which may be up to several centuries. The control of such elements is not detailed here, and essentially depends on the space available in the timepiece for housing the complication.

More particularly, the invention concerns a calendar mechanism 700 for a perpetual calendar device 100 for timepieces.

This calendar mechanism 700 is arranged to display the duration of the current month and includes a month cam 9, whose periphery 90, is accessible to a feeler-spindle 301 of a perpetual calendar device 100 for obtaining information on the duration of the current month.

Calendar mechanism 700 and its month cam 9 are arranged to be updated monthly on each change of current month by such a perpetual calendar device 100.

According to the invention, month cam 9 is generalised to an integer number of years each including a virtual 28-day February, and calendar mechanism 700 includes a leap year mechanism 900.

This leap year mechanism 900 is external to month cam 9, and arranged to insert radially, every four years in the month of February, a first corrector finger 901 between, on the one hand, the periphery 90 of month cam 9, and on the other hand, such a feeler-spindle 301, to inform the latter that the current month of February has 29 days instead of 28.

More particularly, and as illustrated by the Figures, leap year mechanism 900 includes a four-year cam 91, which controls a four-year lever 92. The motion of this four-year lever 92 is permanently transmitted, directly or indirectly to the first corrector finger 901.

In the particular embodiments of FIGS. 1 to 6, the four-year lever 92 carries the first corrector finger 901.

Figure 7:
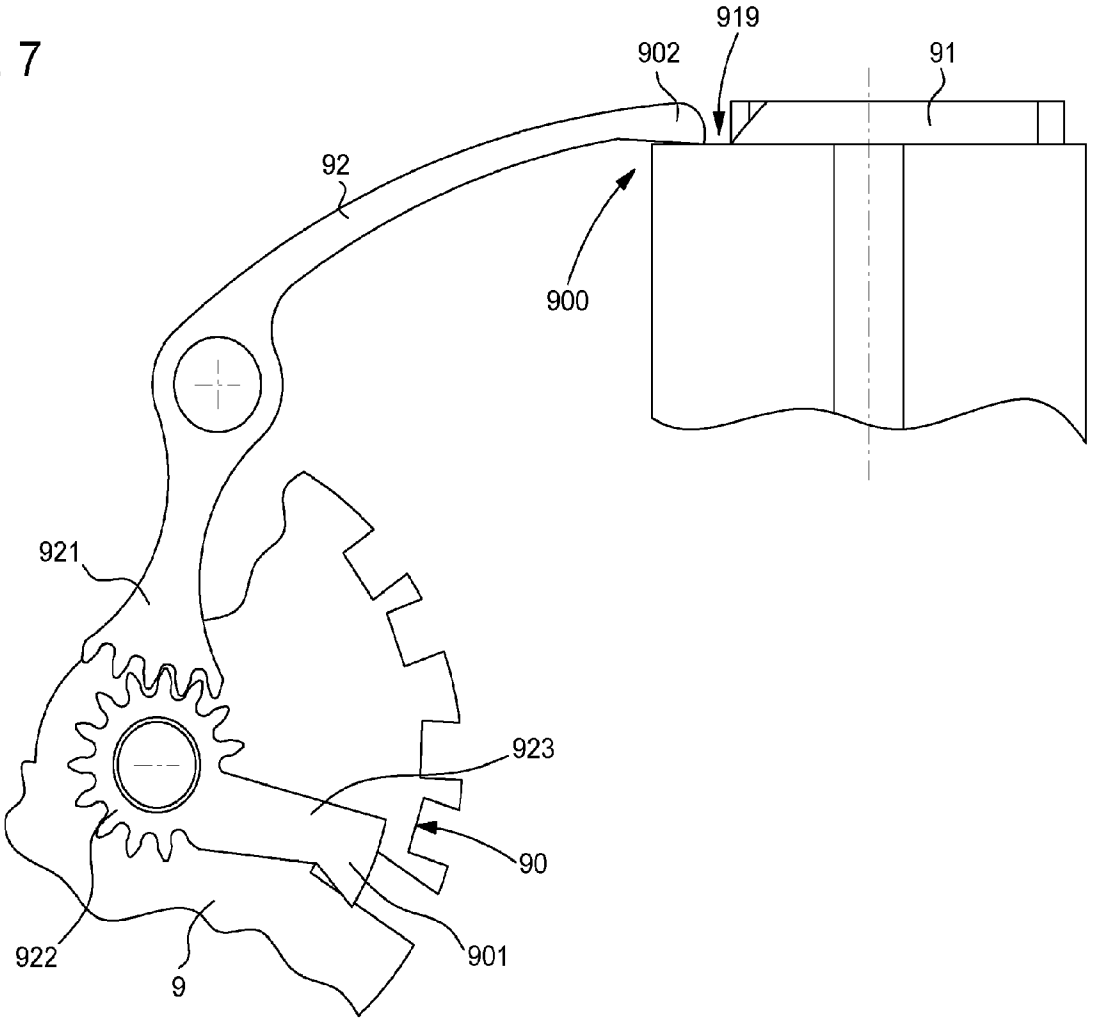
FIG. 7 shows a partial schematic perspective view of the mechanism of FIG. 1.

In the particular embodiment of FIG. 7, the four-year lever 92 is a lifting piece that includes, opposite four-year cam 91, a first toothed sector 922, which meshes with a second toothed sector 922 comprised in an arm 923, which in turn carries first corrector finger 901. More particularly still, as seen in FIG. 7, the four-year cam 91 is coaxial with the second toothed sector 922 of arm 923.

Preferably, the monthly motion of month cam 9 is transmitted, with a suitable transmission ratio, to four-year cam 91.

Figure 5:
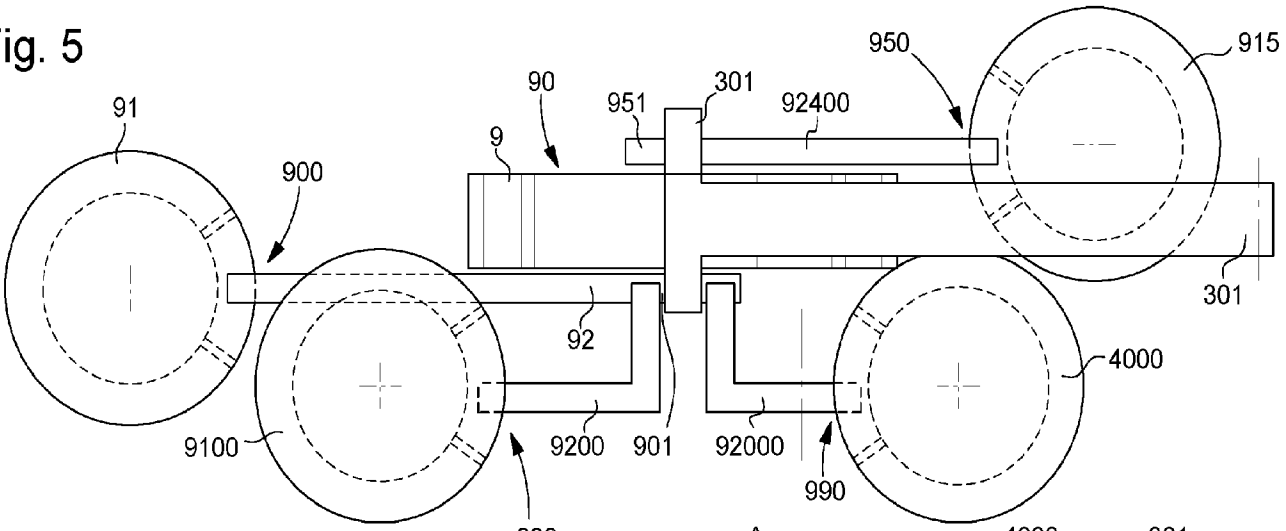
FIG. 5 shows, in a similar manner to FIG. 4, a perpetual calendar device according to the invention, in a complex embodiment including management of leap years, end-of-century years, quadricentennial years, and quadrimillennial years, in the Gregorian calendar.
Figure 6:
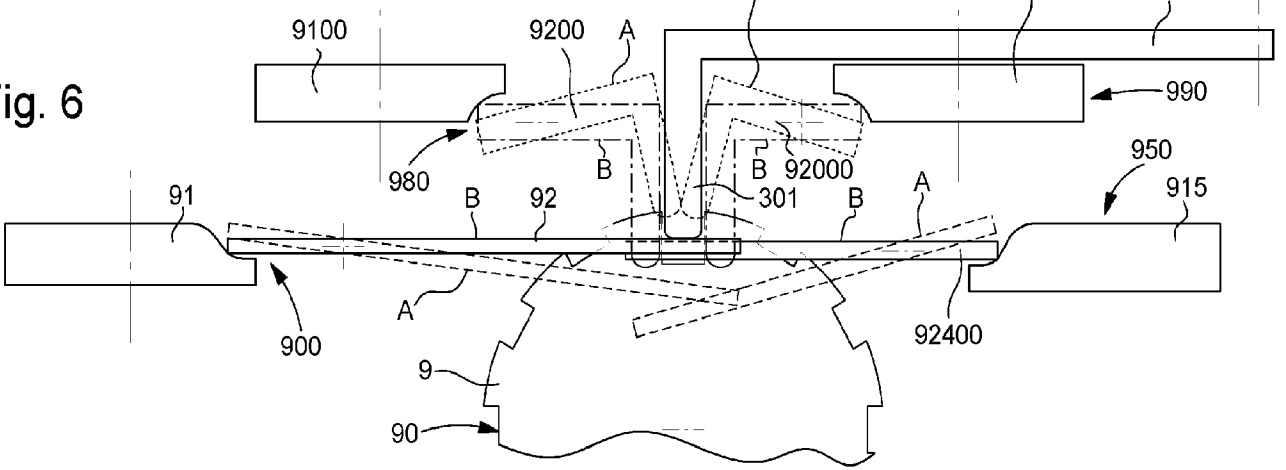
FIG. 6 shows a plan view of the mechanism of FIG. 5, with each correction element being shown in a position marked A where the correction is inactive and a position marked B where the correction is active.

In a particular embodiment, and notably in the specific embodiments of FIGS. 1 to 6, the four-year cam 91 is flat, and four-year lever 92 is movable in a plane parallel to and juxtaposed with that of month cam 9, to cooperate together with a feeler-spindle 301. Preferably, the width of this feeler-spindle 301 is greater than or equal to the total thickness of four-year lever 92 and month cam 9 juxtaposed with each other. It is understood that operation nonetheless remains possible provided that the width of feeler-spindle 301 is sufficient to bear both on four-year lever 92 and on month cam 9. FIGS. 5 and 6 illustrate a more complex mechanism, where the width of feeler-spindle 301 is even greater, in order to cooperate, simultaneously, with four-year lever 92 and month cam 9 and also at least one additional control means.

In a particular embodiment, month cam 9 covers four years each including a 28-day February, and drives four-year cam 91 in synchronous rotation directly, or via a reverser with a ratio of 1.

In a particular embodiment, which is advantageous in its simplicity and compactness, and illustrated by the Figures, month cam 9 covers only one year.

Figure 2:
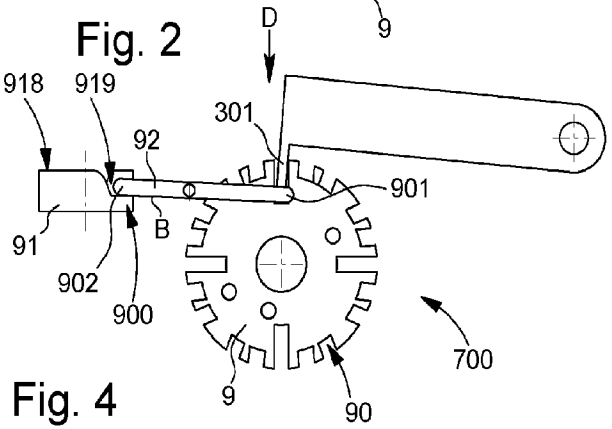
FIG. 2 shows a bottom view of the mechanism of FIG. 1, in the same position.
Figure 4:
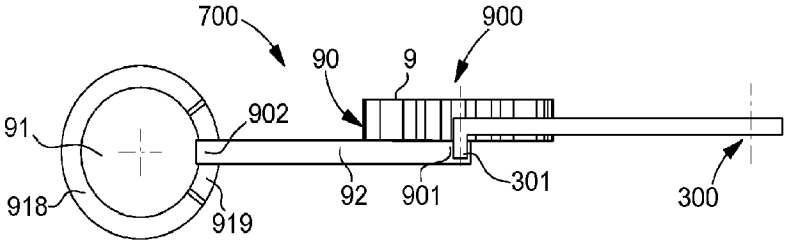
FIG. 4 is a side view, in direction D, of the same mechanism in the position of FIG. 2.
Figure 3:
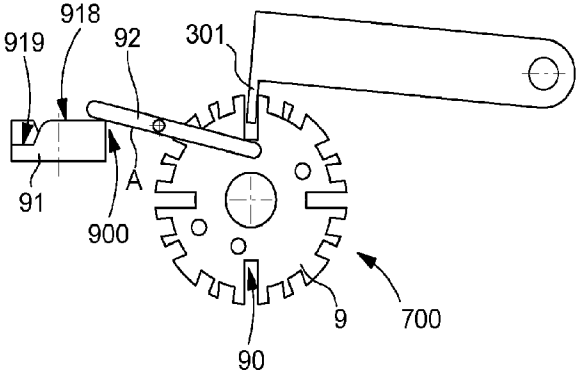
FIG. 3 shows, in a similar manner to FIG. 2, the same mechanism in a position corresponding to a 28-day February, in which the correction mechanism is uncoupled.
Figure 8:
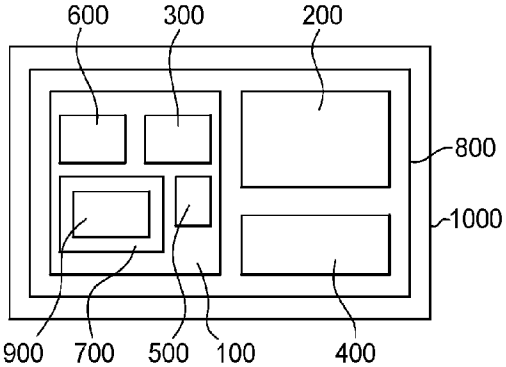
FIG. 8 is a block diagram showing a timepiece, notably a watch, including a timepiece mechanism which in turn includes a timepiece movement and one such perpetual calendar device.

A comparison of FIGS. 2 and 3 clearly illustrates that, in the inactive position B of four-year lever 92 in FIG. 5, its end 901 does not prevent feeler-spindle 301 from feeling the bottom of the notch of periphery 90, which corresponds to a 28-day month, feeler-spindle 301 can then effect the corresponding correction through a jump of the required number of days, and produce the proper display. In the active position A of FIG. 1, end 901 prevents the complete descent feeler-spindle 301, which is stopped in a radial position corresponding to a 29-day month, and initiates the corresponding update and display.

It is noted that, although the principle of the invention finds particularly advantageous application in the duration of February, it is applicable, evidently by replacing four-year cam 91 with a different corrector lever control, to 30 or 31-day months, or to 28 or 29-day moons, or to any other combination or sequence of periods of variable duration.

FIGS. 5 and 6 illustrate a calendar mechanism 700 for an even more precise perpetual calendar, which can be termed a 'true' perpetual calendar.

First of all, a first mechanism manages the quadricentennial years, which have 29-day months of February. Calendar mechanism 700 thus includes a quadricentennial mechanism 950, external to month cam 9, and which is arranged to insert, every four hundred years in February, a second corrector finger 951 between the periphery 90 of month cam 9 and a feeler-spindle 301 to inform the latter that the current month of February has 29 days instead of 28.

More particularly, as seen in FIGS. 5 and 6, the quadricentennial mechanism 950 includes a four-hundred year cam 915 controlling a four-hundred year lever 92400 carrying the second corrector finger 951.

In a higher degree of complication, calendar mechanism 700 controls the end-of-century years, which although theoretically leap years, have a 28-day February. To this end, calendar mechanism 700 includes an end-of-century mechanism 980, external to month cam 9, and which is arranged to uncouple leap year mechanism 900, every hundred years in February, by preventing the insertion of first corrector finger 901 between the periphery 90 of month cam 9 and a feeler-spindle 301.

More particularly, this end-of-century mechanism 980 includes a hundred-year cam 9100 controlling hundred-year lever 9200 arranged to prevent, once every hundred years, the tilting of four-year lever 92. The position B every hundred years forces four-year lever 92 to remain in its inactive position A, since the hundred-year lever 9200 prevents it from returning to its active position B.

In a variant, four-year lever 92 includes a hinge in proximity to a retractable stop member whose movement of retraction is controlled by end-of-century mechanism 980, when the latter operates, to allow the four-year lever to be folded and uncoupled, and the rest of the time said retractable stop member is in a stop position, which prevents the four-year lever 92 being folded down and holds it in a deployed position.

In an even higher degree of complication, more difficult to achieve especially due to gear reduction for control with a very long periodicity, calendar mechanism 700 manages the quadrimillennial years, which, although theoretically leap years, have a 28-day February.

More specifically, calendar mechanism 700 then includes a four-thousand year mechanism 990, external 2 month cam 9, and which is arranged to uncouple leap year mechanism 90, every four thousand years in February, by preventing the insertion of first corrector finger 901 between periphery 90 of month cam 9 and a feeler-spindle 301.

More specifically, the four-thousand-year mechanism 990 includes a four-thousand-year cam 4000 controlling a four-thousand-year lever 92000 arranged to prevent, once every four thousand years, the tilting of four-year lever 92.

In a variant, four-year lever 92 includes a hinge in proximity to a retractable stop member whose movement of retraction is controlled by four-thousand-year mechanism 990, when the latter operates, to allow the four-year lever to be folded and uncoupled, and the rest of the time said retractable stop member is in a stop position, which prevents the four-year lever 92 being folded down and holds it in a deployed position.

The invention also concerns a perpetual calendar device 100 for timepieces including one such calendar mechanism 700, and a day counter mechanism 300 which includes a feeler-spindle 301 for measuring the duration of the current month and an end-of-month correction mechanism 600. The feeler-spindle 301 obtains information on the duration of the current month from the periphery 90 of month cam 9.

According to the invention, the day counter mechanism 300 determines the current day of the month, controls the date display, and on each change of current month, controls a motion of month cam 9 to update calendar mechanism 700, and at least of leap year mechanism 900 which it drives. More specifically, the day counter mechanism 300 also ensures the driving, according to the case, of the four-hundred-year mechanism 950, the end-of-century mechanism 980, the four-thousand-year mechanism 990.

This perpetual calendar device 100 preferably includes a corrector mechanism 500 comprising control means accessible to the user for the control, on the one hand, of the updating of leap year mechanism 900 in a maximum of three actions, and on the other hand, of the updating of month cam 9 in a maximum of eleven actions, in relation to the current display.

More specifically, day counter mechanism 300 is also arranged to control the updating of four-hundred-year mechanism 950, end-of-year mechanism 980, four-thousand-year mechanism 990, and the cams, respectively 915, 9100, 4000, comprised in these mechanisms.

The invention also concerns a timepiece mechanism 800 including a timepiece movement 200 arranged to control the daily release, at the moment that the date changes, of a mechanism actuating such a perpetual calendar device 100, and comprising a display mechanism 400 including at least date display means 412 controlled by calendar mechanism 700.

The invention also concerns a timepiece 1000 including such a timepiece mechanism 800.

What is claimed is:

1. A calendar mechanism for a perpetual calendar device for timepieces, said calendar mechanism being arranged to display the duration of the current month and including a month cam whose periphery is accessible to a feeler-spindle of a perpetual calendar device for obtaining information on the duration of the current month, wherein said calendar mechanism and said month cam are arranged to be updated monthly on each current month change by said perpetual calendar device, wherein said month cam is generalised to an integer number of years each including a virtual 28-day month of February, and in that said calendar mechanism includes a leap year mechanism external to said month cam and arranged to insert radially, every four years in February, a first corrector finger between the periphery of said month cam and a feeler-spindle to inform the latter that the current month of February has 29 days instead of 28.

2. The calendar mechanism according to claim 1, wherein said leap year mechanism includes a four-year cam controlling a four-year lever whose motion is permanently transmitted, directly or indirectly, to said first corrector finger.

3. The calendar mechanism according to claim 2, wherein said calendar mechanism includes an end-of-century mechanism, external to said month cam, and which is arranged to uncouple said leap year mechanism, every hundred years in February, by preventing the insertion of said first corrector finger between the periphery of said month cam and said feeler-spindle, and said end-of-century mechanism includes a hundred-year cam controlling a hundred-year lever arranged to prevent, once every hundred years, the tilting of said four-year lever.

4. The calendar mechanism according to claim 2, wherein said four-year lever carries said first corrector finger.

5. The calendar mechanism according to claim 2, wherein said four-year lever is a lifting piece that includes, opposite said four-year cam, a first toothed sector, which meshes with a second toothed sector comprised in an arm, which carries said first corrector finger.

6. The calendar mechanism according to claim 5, wherein said four-year lever is coaxial with said second toothed sector of said arm.

7. The calendar mechanism according to claim 2, wherein the monthly motion of said month cam is transmitted, with a suitable transmission ratio, to said four-year cam.

8. The calendar mechanism according to claim 2, wherein said four-year cam is flat, and in that said four-year lever is movable in a plane parallel to and juxtaposed with that of said month cam to cooperate together with said feeler-spindle whose width is greater than or equal to the total thickness of said four-year lever and of said month cam juxtaposed with each other.

9. The calendar mechanism according to claim 2, wherein said month cam covers four years each including a 28-day February, and drives said four-year cam in synchronous rotation directly, or via a reverser with a ratio of 1.

10. The calendar mechanism according to claim 1, wherein said month cam covers only one year.

11. The calendar mechanism according to claim 10, wherein said calendar mechanism includes a quadrimillennial mechanism, external to said month cam, and which is arranged to uncouple said leap year mechanism, every four thousand years in February, by preventing the insertionof said first corrector finger between the periphery of said month cam and said feeler-spindle.

12. The calendar mechanism according to claim 11, wherein said calendar mechanism includes an end-of-century mechanism, external to said month cam, and which is arranged to uncouple said leap year mechanism, every hundred years in February, by preventing the insertion of said first corrector finger between the periphery of said month cam and said feeler-spindle, and said quadrimillennial mechanism includes a four-thousand-year cam controlling a four-thousand-year lever arranged to prevent, once every four thousand years, the tilting of said four-year lever.

13. The calendar mechanism according to claim 1, wherein said calenda mechanism includes a quadricentennial mechanism, external to said month cam, and which is arranged to insert, every four hundred years in February, a second corrector finger between the periphery of said month cam and said feeler-spindle to inform the latter that the current month of February has 29 days instead of 28.

14. The calendar mechanism according to claim 13, wherein said quadricentennial mechanism includes a four-hundred-year cam controlling a four-hundred-year lever carrying said second corrector finger.

15. The calendar mechanism according to claim 1, wherein said calendar mechanism includes an end-of-century mechanism, external to said month cam, and which is arranged to uncouple said leap year mechanism, every hundred years in February, by preventing the insertion of said first corrector finger between the periphery of said month cam and said feeler-spindle.

16. A perpetual calendar device for timepieces including a calendar mechanism according to claim 1 and a day counter mechanism which includes a feeler-spindle for measuring the duration of the current month and an-end-of month correction mechanism, said feeler-spindle obtaining information on the duration of the month from said periphery of said month cam, wherein said day counter mechanism determines the current day of the month, controls the date display, and, on each change of current month, controls a motion of said month cam to update said calendar mechanism, and said leap year mechanism which it drives.

17. The perpetual calendar device according to claim 16, wherein said perpetual calendar device includes a corrector mechanism comprising control means accessible to the user for the control, on the one hand, of the updating of said leap year mechanism in a maximum of three actions, and on the other hand, of the updating of said month cam in a maximum of eleven actions, in relation to the current display.

18. A timepiece mechanism including a timepiece movement arranged to control the daily release, at the moment that the date changes, of a mechanism actuating a perpetual calendar device according to claim 16, and comprising a display mechanism including at least date display means controlled by said calendar mechanism.

19. A timepiece movement including a timepiece mechanism according to claim 18.

* * * * *